US005664953A

United States Patent [19]

Reylek

[11] Patent Number: 5,664,953

[45] Date of Patent: Sep. 9, 1997

[54] ELASTOMERIC LOCKING TAPER CONNECTOR WITH RANDOMLY PLACEABLE INTERMESHING MEMBER

[75] Inventor: Robert S. Reylek, Minneapolis, Minn.

[73] Assignee: Minnesota Mining and Manufacturing Co., St. Paul, Minn.

[21] Appl. No.: 715,917

[22] Filed: Sep. 19, 1996

Related U.S. Application Data

[63] Continuation of Ser. No. 279,441, Jul. 25, 1994.

[51] Int. Cl.[6] ..... H01R 25/00

[52] U.S. Cl. ..... 439/111; 439/86; 439/496

[58] Field of Search ..... 439/86, 110, 111, 439/112, 113, 114, 115, 116, 119, 120, 122, 496

[56] References Cited

U.S. PATENT DOCUMENTS

| | | | |
|---|---|---|---|
| 2,108,031 | 2/1938 | Acuff | 439/111 |
| 4,098,945 | 7/1978 | Oehmke . | |
| 4,734,045 | 3/1988 | Hawkins | 439/79 |
| 4,812,134 | 3/1989 | Miller et al. | 439/110 |
| 4,875,259 | 10/1989 | Appeldorn . | |
| 4,881,907 | 11/1989 | Bergman et al. . | |
| 4,971,575 | 11/1990 | Martellotti | 439/496 |
| 5,071,363 | 12/1991 | Reylek et al. . | |
| 5,176,530 | 1/1993 | Reylek et al. . | |
| 5,207,589 | 5/1993 | Lettenmayer | 439/122 |
| 5,213,715 | 5/1993 | Patterson et al. | 252/518 |
| 5,378,161 | 1/1995 | Loder | 439/77 |

FOREIGN PATENT DOCUMENTS

| | | |
|---|---|---|
| 1 171 469 | 6/1964 | Germany . |
| 85 36 122 | 4/1987 | Germany . |
| WO87/03998 | 12/1986 | WIPO . |
| WO91/16737 | 10/1991 | WIPO . |

OTHER PUBLICATIONS

Gurland, "An Estimate of Contact and Continuity of Dispersions in Opaque Samples", in *Transactions of the Metallurgical Society of AIME*, vol. 236, pp. 642–646 (May 1966).

*Primary Examiner*—Neil Abrams
*Assistant Examiner*—Barry Matthew L. Standig
*Attorney, Agent, or Firm*—Merchant, Gould, Smith, Edell, Welter & Schmidt, P.A.

[57] ABSTRACT

An intermeshable electrical connector comprises a flexible electrically conductive member having electrically conductive elements along an outer surface for forming electrical connections with a rigid member having electrically conductive elements along an outer surface, these elements being correspondingly configured to the elements on the flexible member. The rigid member may be intermeshed with the flexible member at a desired location in a releasable engagement, forming the electrical connections, while allowing for subsequent release and reconnection without stripping, damaging or penetrating the electrically conductive elements of the flexible member.

17 Claims, 7 Drawing Sheets

ELASTOMERIC LOCKING TAPER CONNECTOR WITH RANDOMLY PLACEABLE INTERMESHING MEMBER

This is a Continuation of application Ser. No. 08/279,441, filed Jul. 25, 1994.

FIELD OF THE INVENTION

This invention relates to an apparatus that involves multiple conductor electrical connectors. These connectors employ self locking tapers and have a first electrically conductive flexible member which receives a correspondingly configured second rigid electrically conductive member at a desired location along its length to intermesh in a releasable engagement, forming one or more electrical connections.

BACKGROUND OF THE INVENTION

There remains a need for reliable, low cost, electrical connectors which can be subjected to repeated connections and disconnections at desired random locations without damage to the connector components. For example, in standard multiple pin plugs, each pin is connected to a corresponding receptacle in the plug by an independent connection. Repeated attachments of the pin holding component in the receptacle component, along with movement of the pins within the receptacle component, wears down the conducting surfaces of both the pins and the receptacles. The worn down surfaces loose their metalized coating and begin to oxidize. At the same time, the pins may loosen. As a result, electrical contact resistance increases to a point where the connector is considered to have failed.

Electrical connectors utilizing interlocking tapers to maintain intermeshable contact between the electrically conducting components have been disclosed in U.S. Pat. No. 5,071,363 to Reylek et al. This patent discloses an electrical connector comprising intermeshable members. The members cooperate to insure electrical connection in a compression contact as the members interact with each other. Each of the members is of a rigid material and has an electrically insulative body with a structured surface including a plurality of tapered elements. The tapered sides of each member include electrically conductive material such that when the members are intermeshed, there is an electrical connection, which is retained by frictional forces created by the interlocking tapers between the members. The connection between members is maintained until a sufficient force is applied to disengage the members.

The geometry requisite for this intermeshing and subsequent retention is described in U.S. Pat. No. 4,875,259 to Appeldorn. Although this reference does not mention electrical connectors, it describes intermeshable members that can be used in pairs as mechanical fasteners. Each of the members has a structured surface including a plurality of tapered elements, each element having at least one side inclined relative to a common plane at an angle sufficient to form a taper. Upon being intermeshed with the tapered sides of the two elements in contact, the pair of members become frictionally interlocked when the tangent of the half angle of the tapered sides is no greater than the coefficient of friction of the material of the contacting surfaces. Individual tapered elements can be exceedingly small.

The connectors disclosed in Reylek et al. were designed to carry current over distances of centimeters. This is because their relatively thin conductors and rigidity gave rise to substantial resistance at distances beyond a few centimeters. As a result, these connectors remained limited to short distance lengthwise current transport.

Flexible electric current carrying devices, referred to in the trade as "zebra strips" are known. These zebra strips are solid rectangular elastomers with conductive particle slices interspersed along their length. They are made by laminating alternating layers of conducting and insulating materials, followed by skiving. These zebra strips are limited to conducting electric current along their thickness or width. They exhibit the same drawback as the Reylek et al. connectors, in not being able to conduct current along their length, because the conductive slices are high in resistivity.

Electrically conducting particles have been imbedded in elastomers, such as rubbers. These particle imbedded elastomers are made by orienting the particles in the rubber with magnetic fields during manufacturing. However, these particle imbedded elastomers exhibit high resistivity, and as a result are used only for electric current transport over lengths no more than a few millimeters. More common uses of these particle imbedded elastomers include gaskets and seals for doors on electrical cabinets and the like.

It has also been desirable to eliminate the use of wires, cables or other long cord lengths from electrical devices to an apertured electrical receptacle, i.e., telephone jack, antenna connector, low voltage electrical outlets. Long cord lengths detract from the aesthetics of a room and may cause injuries if people step on or trip over the cord. Furthermore, the cord length and fixed receptacle position may constrain the location of an electrical device to an inconvenient position.

SUMMARY OF THE INVENTION

The present invention overcomes the problems of the prior art by providing an electrical connector system, primarily useful at low voltages, for carrying electric current or electric signals over distances anywhere between one centimeter and ten meters, with a negligible amount of resistance and negligible voltage drop along the length of the system. The electrical connector system of the present invention is formed of a flexible electrically conductive member intermeshable with a rigid electrically conductive member which is randomly placable at a desired location along the flexible member. The flexible member forms electrical contacts at selected areas under the application of pressure from the second electrically conductive member, which is correspondingly configured with the flexible member. The flexible member remains insulative in other areas.

This flexible electrically conductive member includes an outer surface formed by a plurality of electrically conductive protruding elements. The electrically conductive rigid member includes electrically conductive elements correspondingly configured to those of the flexible member. This configuration allows the flexible member and the rigid member to intermesh with a force sufficient to ensure electrical connection, while also allowing for subsequent release and reconnection of the rigid member to the flexible member at the same or a different point of attachment, without stripping, damaging, or penetrating the electrically conductive elements in the flexible member.

In another aspect of the invention, the outer surface of the flexible electrically conductive member is formed of protruding tapered elements. Electrically conductive wires are imbedded in these tapered elements. These wires are surrounded by an electrical conducting particle filled elastomer which extends to the edge surfaces of the tapered elements of the flexible member, providing an electrically conductive surface. Upon intermeshing with a rigid member having correspondingly configured electrically conducting surfaces, electrical connections are made.

BRIEF DESCRIPTION OF THE DRAWINGS

The present invention will be described with reference to the accompanying drawings, wherein like reference numerals identify corresponding or like components.

In the drawings.

DETAILED DESCRIPTION OF THE DRAWINGS

Figure 1:
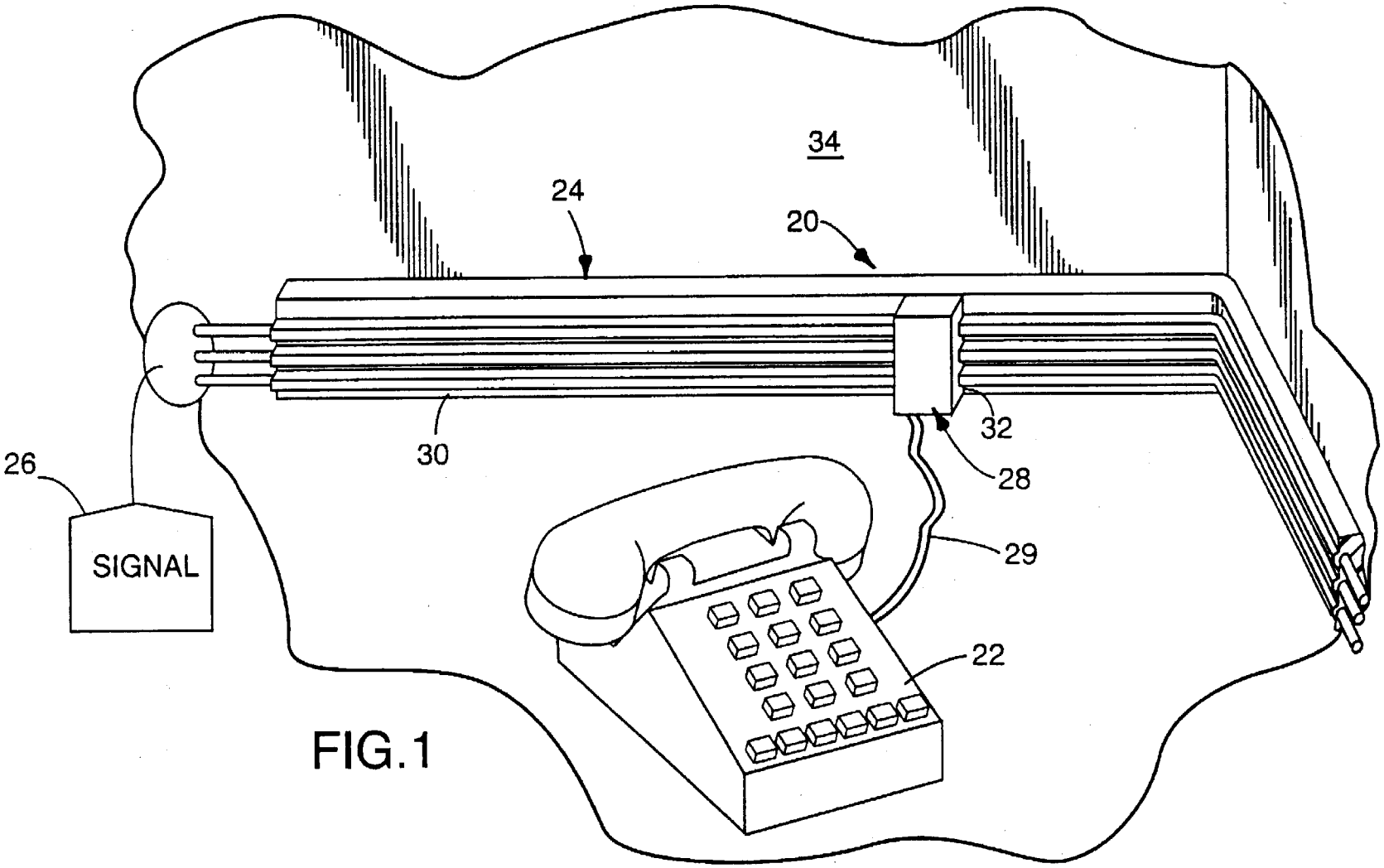
FIG. 1 is a perspective view of the present invention.

FIG. 1 shows the locking taper electrical connector 20 of the present invention in use as an electric signal carrier for an electrical device such as a telephone 22. The locking taper connector 20 includes an electrically conductive flexible non-rigid member 24, which receives current from an external power or signal source 26. An electrically conductive rigid member 28, connected to the telephone 22 by a cord 29, is in intermeshing contact with the flexible member 24 to form the electrical connection necessary to supply signal current to the telephone 22. This intermeshing contact for the necessary electrical connection is achieved through correspondingly configured electrically conducting outer surfaces 30, 32.

The locking taper connector 20 of the invention is in use along a baseboard 34, wall, floor or other support structure. The flexible member 24 is ribbon-like in structure. It is connected to the baseboard 34 by conventional fastening techniques such as adhesive bonding, mechanical fastening or the like. This rigid member 28 is then attached to this flexible member 24 at any desired position along the length of the flexible member 24, depending upon where the phone 22 is to be placed. The rigid member 28 can be disconnected from the flexible strip member 24 and repeatedly reconnected at any location along the flexible strip member 24 without stripping, damaging, or penetrating the flexible strip member 24. While only one rigid member 28 is shown intermeshed to the flexible member 24, the flexible member 24 can accommodate several rigid members at once, providing electric signals (or electric current) to several low voltage electrical devices.

The flexible member 24 preferably runs for approximately one half meter to ten meters along a wall, floor or baseboard in a room, and can be bent around corners. This feature enables the user to make the requisite electrical connections where desired. As a result, the cord route is as direct as possible. This eliminates extension cords and other long cords, that are both unaesthetic and hazardous, for example, people could trip over these cords. Additionally, there are more options for locating the electrical device so as not to inconvenience the user.

Since low voltage electric signals (or electric current) are preferably carried along the length of the electrically conductive flexible member 24, this flexible member 24 can be left exposed without the risk of electric shock to humans or animals. If additional aesthetics are desired, the flexible member 24 can be covered and exposed only at the desired points of use. Since low voltage applications are preferred, the locking taper connector 20 is particularly useful for low voltage electrical devices such as telephones, lamps, stereo loudspeakers or the like.

Figure 2:
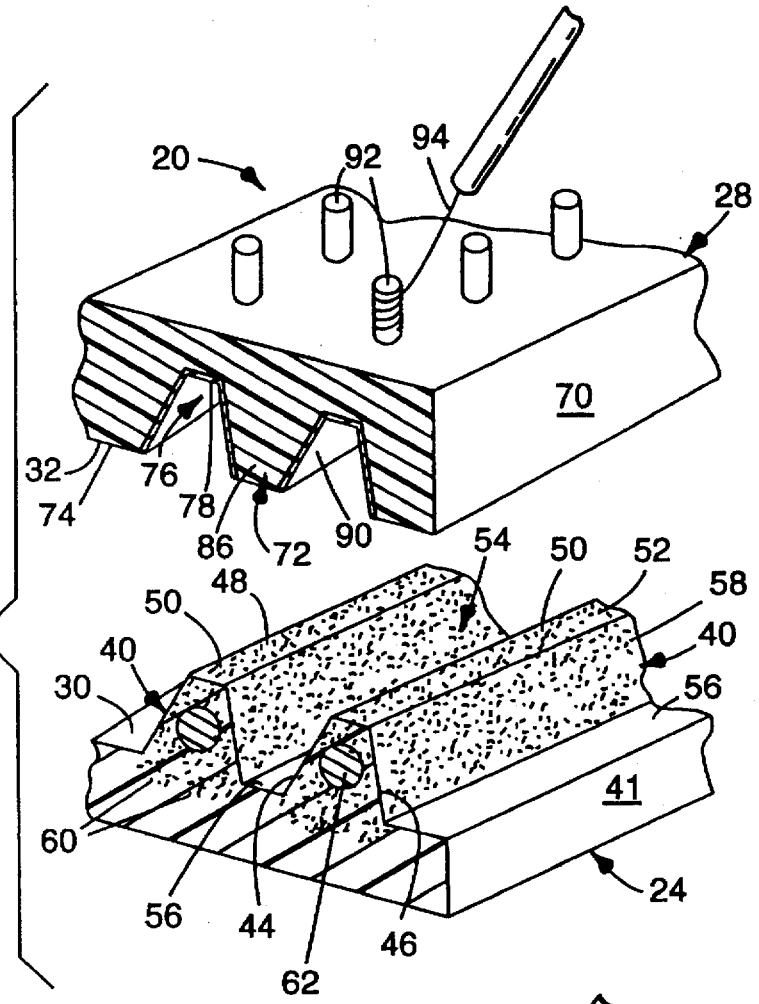
FIG. 2 is a broken away exploded view of a portion of the present invention;.
Figure 2A:
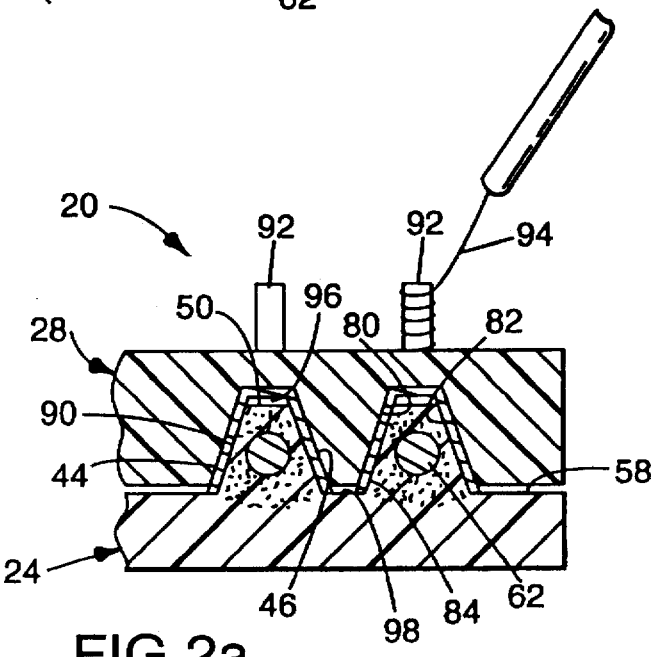
FIG. 2*a* is a broken away cross sectional view of a portion of the present invention.

FIGS. 2 and 2*a* show a portion of the locking taper connector 20 of the invention in detail, with the electrically conductive flexible member 24 and the rigid member 28 intermeshed, forming an electrical connection. The flexible member 24, includes tapered elements 40 on its outer or major surface 30 for intermeshing with the correspondingly configured outer surface 32 on a rigid electrically conducting member 28.

The flexible member 24 includes a body 41, of an electrically insulative material, with outwardly protruding tapered elements 40, along its outer surface 30. Each tapered element 40 includes two sides 44 and 46, terminating in a crown 48, preferably having a flat surface 50. The tapered elements 40 are shaped and have taper geometries in accordance with U.S. Pat. Nos. 4,875,529 to Appeldorn and 5,071,363 to Reylek et al., both patents are incorporated by reference herein.

The tapered elements 40 are arranged side by side, forming a plurality of linear ridges 52 and grooves 54. Each groove 54 is provided with a trough 56, which separates adjacent tapered elements 40. The tapered elements 40 include electrically conductive peripheral surfaces 58, across the flat surfaces 50 of the crowns 48 and adjacent tapered sides 44 and 46. These electrically conductive peripheral surfaces 58 generally do not extend into the troughs 56 between the tapered elements 40. As a result, the chances for short circuiting when the flexible and rigid members 24, 28 are intermeshed is greatly decreased.

The electrically conductive peripheral surfaces 58 of the flexible member 24 are on the tapered elements 40 and formed of an electrically conductive particle filled elastomer with electrically conductive particles 60 impregnated into the tapered elements 40, surrounding wires 62. The preferred wires are copper, with other similar electrically conducting wires also permissible.

The particles 60 are in electrical contact with the wires 62, providing the flexible member 24 with high electrical conductivity under the application of relatively low pressures while maintaining electrically insulating characteristics in areas where electrical contact is not intended. The particles preferably extend from the wires 62 to the crown 48 and adjacent sides 44, 46 of the tapered elements 40, and possibly into the portions of the body 41 proximate to the tapered elements 40. Specifically, the particles 60 extend to the peripheral surfaces 58 of the tapered elements 40, such that these peripheral surfaces 58 and hence, the outer surface 30 of the flexible member 24 is electrically conductive. The wires 62 are supplied with low voltage electrical current from an external power or signal source 26 (FIG. 1), and extend the length of the flexible member 24. This arrangement can carry current over the entire length of the flexible member 24 with minimal voltage loss.

Alternately, the particles 60 may be dispersed within the flexible member in other configurations. For example, particles may be dispersed throughout the entirety of the body of the flexible member, including the tapered elements. An advantage of this arrangement is that the flexible member can be made in a single step as opposed to the multiple step manufacturing process described below.

The actual number of particles is controlled, depending on whether the flexible member 24, in particular the tapered elements 40, is to be pressure sensitive or non-pressure sensitive. The tapered elements 40 are preferably pressure sensitive, such that electrical conductivity increases with increased pressure, which occurs upon intermeshing the flexible and rigid members 24, 28. The tapered elements 40 may also be non-pressure sensitive.

Figure 7:
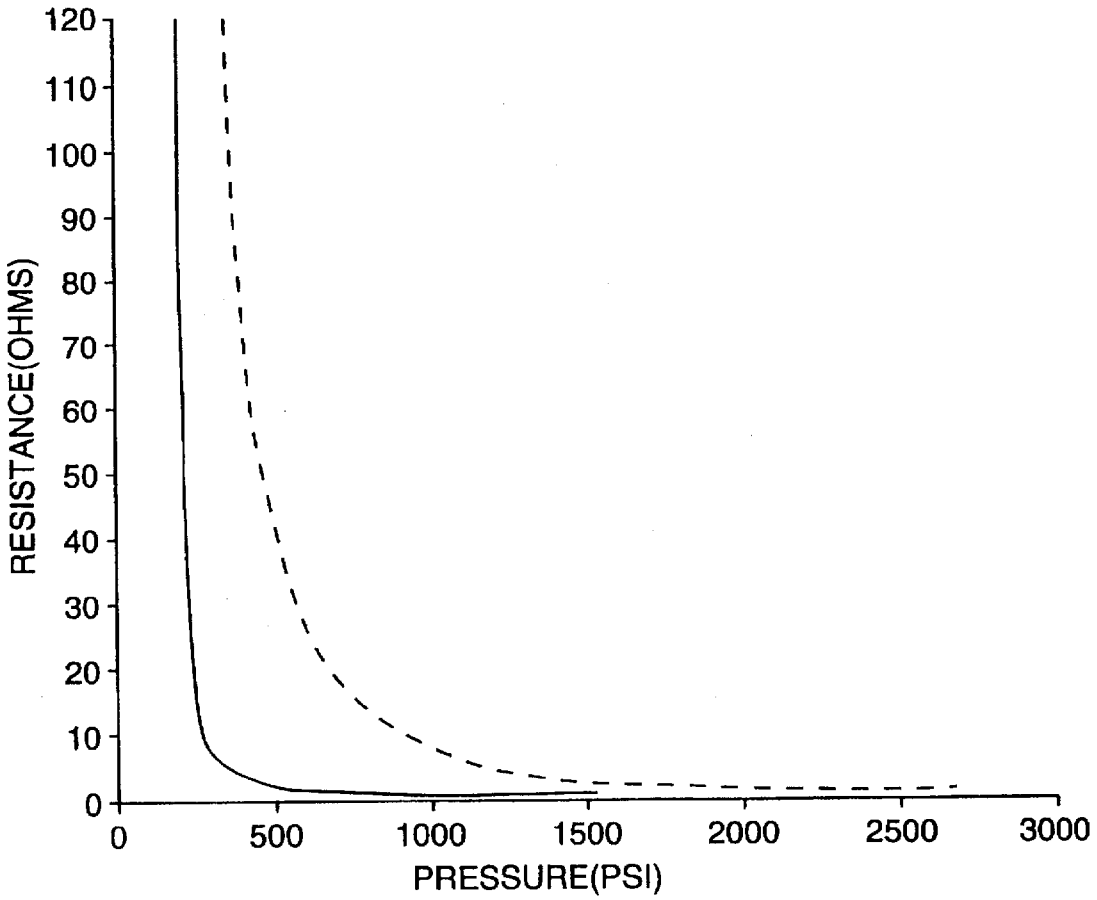
FIG. 7 is a graph of resistance versus pressure for sample materials made in accordance with the present invention, having different concentrations of particle loadings.

Pressure sensitivity is dependent upon the concentration of particle loading. The effect of various concentrations of particle loadings is illustrated graphically in FIG. 7. When the flexible member 24 is pressure sensitive, it remains insulative in areas where the rigid member is not connected, avoiding accidental short circuits.

Nickel is the preferred material for the electrically conductive particles. Gold, copper, silver or metalized particles such as silver or gold on nickel or copper, or other equivalent conducting materials, are also suitable. Metalized polymer dielectric balls are also suitable. The electrically conductive particles must be chemically and electrically compatible with the imbedded wires 62 and the outer surface 32 (including the electrically conducting segments 90) of the rigid member 28. Chemical compatibility requires that the metals which comprise the particles 60, wires 62, and electrically conducting segments 90, be nonreactive with respect to each other. Electrical compatibility requires that the particles 60, wires 62 and electrically conducting segments 90, should have sufficiently low resistance to conduct electrical current or electrical signals.

The flexible member 24 is non-rigid and preferably made of elastomeric materials such as silicones, urethanes, fluoroelastomers, or the like. Flexibility of this member 24 allows the tapered elements 40 of the flexible member 24 to be pressure sensitive. Pressure sensitive tapered elements 40 compress when placed under pressure during intermeshing, such that the flexible member 24 becomes electrically conductive in selected areas while remaining electrically insulative in other areas. Additionally, the compliance of the flexible member 24 is such that contact between the tapered elements 40 on the flexible member 24 and the tapered elements 72 on the rigid member 28 is maximized. As a result, the compression between the tapered elements 40, 72 of the flexible and rigid members 24, 28, creates enhanced electrical contact between the electrically conducting surfaces of the flexible member 24 and electrically conducting segments 90 of the rigid member 28, giving rise to low resistance electrical connections.

The flexible member 24 is made in portions. Initially, a mold corresponding to the tapered elements is filled with an elastomer, impregnated with electrically conducting particles. Wires are then strung in this portion of the mold corresponding to the tapered elements. A layer of elastomer without particles is placed over the portion forming the tapered elements. Once both layers have cured, the entire member is removed from the mold.

Alternately, the flexible member 24 may be formed by replicating the outer surface 30 on a reusable master. The surface of the master is a negative of the tapered elements 40 that are to be formed. If high speed replication is desired, a thermoplastic resin can be cast, extruded, injected into, or otherwise formed on the surface of the master. The master is preferably heat conducting, to provide quick solidification of the formed thermoplastic, coupled with cooling and reuse of the master. The elastomer filled with conductive particles may be extruded over the embedded wire. Stainless steel is a preferred material for the master, with other similar materials also being suitable.

The electrically conductive rigid member 28 includes a body 70 with tapered elements 72 along its outer surface 32. The tapered elements 72 are arranged side by side forming a plurality of linear ridges 74 and grooves 76. Each groove 76 is provided with a trough 78, which separates adjacent tapered elements 72.

The outer surface 32 of the rigid member 28 is formed by tapered elements 72 having tapered sides 80, 82 terminating in a crown 84 with a flat surface 86. The preferred tapered elements 72 on this rigid component member 28 have taper shapes and geometries in accordance with U.S. Pat. Nos. 4,875,259 to Appeldorn and 5,071,363 to Reylek et al. These tapered elements 72 are cooperatively configured with those tapered elements 40 forming the outer surface 30 of the flexible member 24. Electrically conductive segments 90 extend along portions of the tapered elements 72. The electrically conductive segments 90 on the outer surface 32 extend through the troughs 78 and along the sides 80, 82 of the tapered elements 72, terminating at approximately the crowns 84, such that when the rigid member 28 is intermeshed with the flexible member 24 in a releasable engagement, electrical connections are formed. The flat surface 86 of the crown 84 between the sides 80, 82 of the tapered elements 72 remains free of electrically conductive material, to avoid short circuiting in the locking taper connector 20.

The rigid member 28 includes terminals 92 in electrical contact with the electrically conductive segments 90. These terminals 92 connect to wires 94 of the device to be used. Preferably, both the electrically conductive segments 90 and the wire terminals 92 are made of copper, copper alloys, or other similar electrically conducting materials.

The body 70 of the rigid member 28 is formed by conventional techniques such as injection molding, casting, or extrusion of an electrically insulating polymer. Preferred polymers include: polyetherimides such as ULTEM®, available from the General Electric Company, Fairfield, Conn.; polyethersulfones, such as UDEL® and RADEL®, and liquid crystal polymers, such as XYDAR®, available from AMOCO Corporation, Chicago, Ill. Additional useful polymers include, but are not limited to, thermoplastics such as acrylics, vinyls, polyethylenes, polypropylenes, polycarbonates, and polyesters, such as polyethylene terephthalate (PET).

A thin metal film is then placed on the outer surface by techniques such as electroless deposition, vapor deposition, or the like. A thicker metal layer, of the same or a different metal than the thin film layer, is then electroplated onto the thin film layer. Portions of this metal outer surface are then completely removed down to the insulating material which forms the outer surface, by conventional techniques, such as abrasion with a diamond saw, resulting in separate electrically conducting segments, electrically insulated from each other.

Turning specifically to FIG. 2*a*, the flexible and rigid members 24, 28 are shown in an intermeshing engagement.

This intermeshing engagement and retention of the flexible and rigid members 24, 28 is achieved as the tapered elements 40, 72 on the respective flexible and rigid members 24, 28 are preferably of equal height, with the widths of the crown surfaces 50, 86 slightly greater than the width of the troughs 56, 78. As a result of this structure, the tapered elements 40, 72 of the flexible and rigid members 24, 28 upon intermeshing will contact each other along the respective tapered sides 44, 46, 80, 82. This contact upon intermeshing provides cavities 96, 98, between the flexible and rigid members 24, 28, and facilitates adherence, the degree of which may vary depending upon the angle of the taper and/or the frictional forces associated with the sides 44, 46, 80, 82 of the intermeshing tapered elements 40, 72. The crowns 48, 84 and troughs 56, 78 of the respective flexible and rigid members 24, 28 can touch, provided the force associated therewith is greater than the frictional forces associated with the respective tapered sides 44, 46, 80, 82. As a result, the flexible and rigid members 24, 28 are retained together by sufficient frictional forces created by the interlocking tapered elements 40, 72, so as not to be easily separated, but can be manually separated from this intermeshing engagement if so desired.

Alternate embodiments of the flexible and rigid members 24, 28 possess tapered elements 40, 72, with taper shapes and geometries in accordance with those disclosed in U.S. Pat. Nos. 4,875,259 to Appeldorn and 5,071,363 to Reylek et al., to provide the requisite frictional forces for retention. These alternate embodiments differ from those described above, as the widths of the crown surfaces 50, 86 and of the troughs 56, 78 on each member 24, 28 may be varied, provided both the flexible and the rigid members 24, 28 remain correspondingly configured. Additionally, one or a few crown surfaces and troughs on one member may be of a first series of widths, while the remaining crown surfaces and troughs on that same member may be of a second series of widths. The opposite member would be correspondingly configured. This arrangement, with the first and second series of widths for the crown surfaces and troughs on each member forms a keying type arrangement, to promote intermeshing of crowns from one member to troughs on the other member at specific locations to allow corresponding conductors on the flexible and rigid members to form electrical contacts. For example, this feature allows for the bidirectional transmission of the electrical signals, completing the electrical circuit.

In the embodiments described above, the frictional forces of intermeshing are sufficient to retain the subsequent electrical connections for the time period desired. The electrical connections may be reinforced, with clips or other external retaining devices.

Other alternate connector embodiments may include the above described flexible member 24 in combination with rigid members having outer surfaces with structures sufficient to form electrical connections with the electrically conducting tapered elements 40 of the flexible member 24. These rigid members need not have outer surfaces correspondingly configured to that of the outer surface 30 of tapered elements 40 of the flexible member 24. The outer surface of the rigid member, which forms the electrical connections, may include structures such as electrical pads. These electrical pads may be placed either, into full or partial contact with the flat crown surface 50, or into the groove 54 between the tapered elements 40 to partially intermesh, without necessarily interlocking. Additionally, the electrical pads may be configured in a combination of both of these arrangements. This electrical contact could be maintained by additional members such as clips or other external retaining devices.

The preferred locking taper connector is small in size in order to interconnect arrays of closely spaced terminals and for thin cables to inconspicuously connect components at extended distances. Each pair of connectors preferably has as few as two and as many as fifty tapered elements, although other arrangements are also permissible. For example, there may be from 0.25 to 10.0 conductive segments per millimeter. The heights of the tapered elements on both the flexible member and the rigid member may preferably range from 0.2 to 10.0 millimeters to accommodate multiple terminals.

Figure 3:
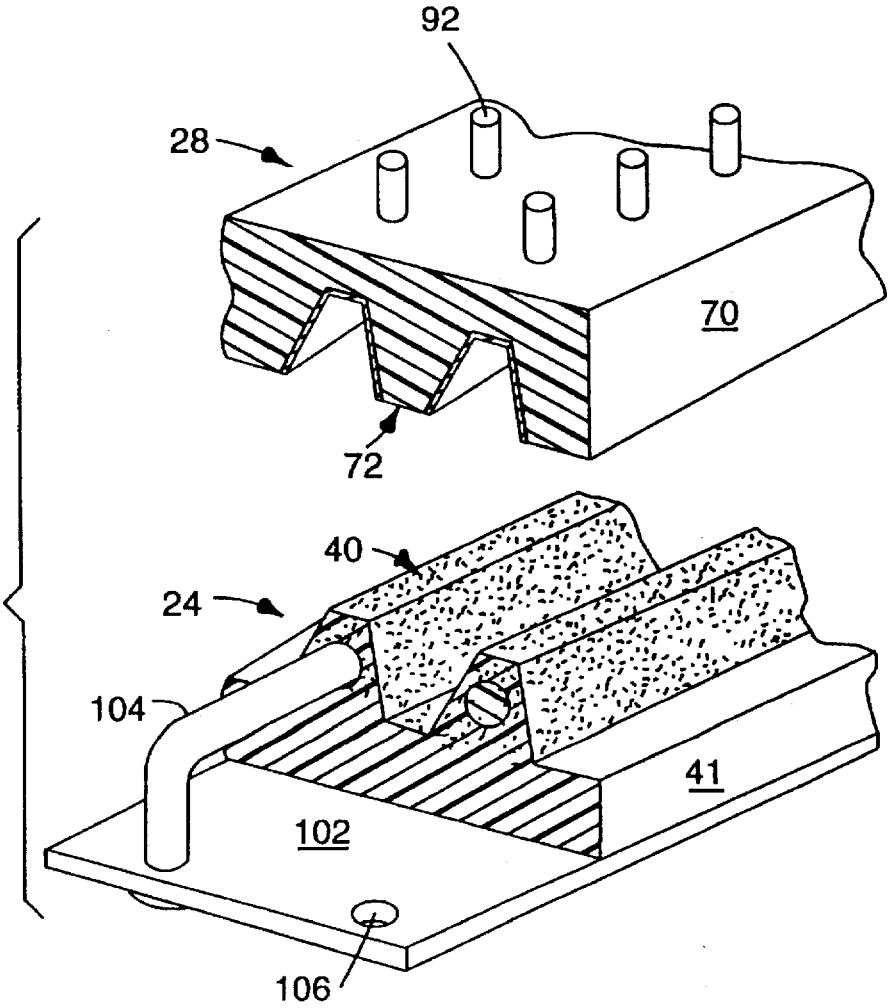
FIG. 3 is a broken away view of a second embodiment of the present invention.

FIG. 3 shows the locking taper connector 20 of FIGS. 2 and 2*a* in use on a printed circuit board 102. Wires 104 (one wire is not shown) for carrying electric current or signals extend from the tapered elements 34 and are connected through openings 106 in the printed circuit board 102 by soldering. Similarly, the rigid member 28 includes terminals 92 for wires. The flexible member 24 is attached to the printed circuit board 102 by conventional fastening techniques such as adhesive bonding, mechanical fasteners or the like.

Figure 4:
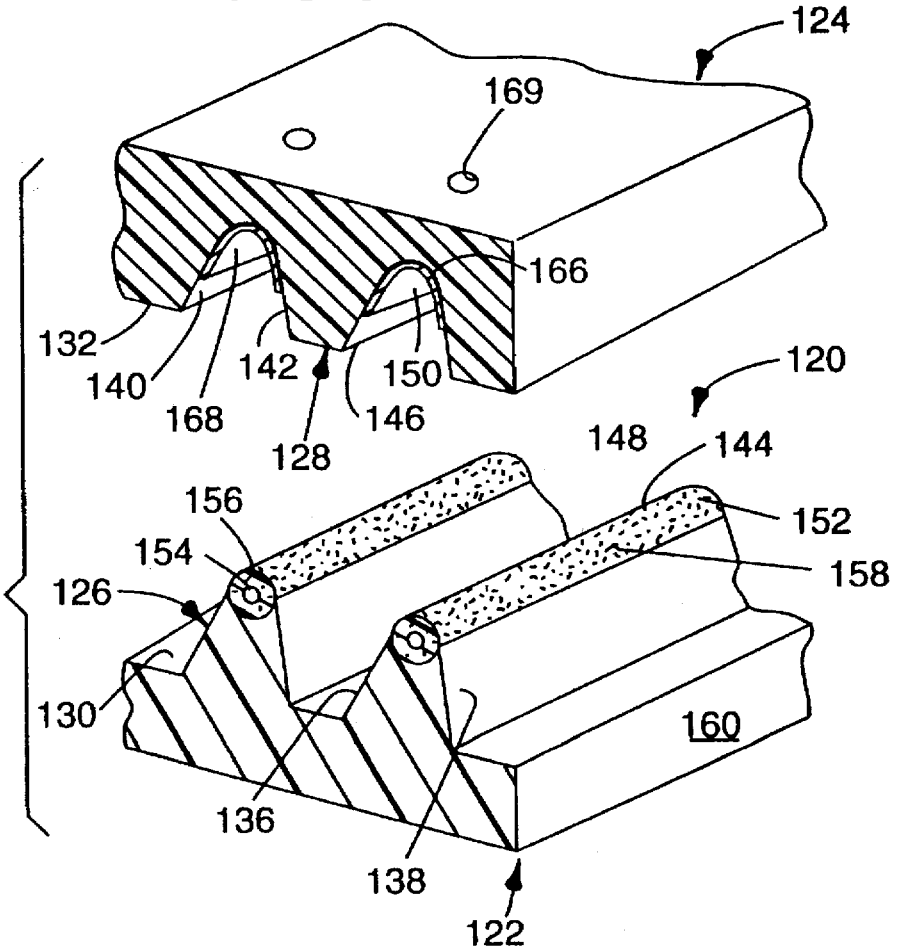
FIG. 4 is a broken away exploded view of a third embodiment of the present invention.

FIG. 4 shows a third locking taper connector 120 of the invention. Similar to the locking taper connectors described in FIGS. 2 and 2*a* above, the connector 120 includes an electrically conducting flexible strip member 122 and a correspondingly configured electrically conducting rigid member 124. Both members have correspondingly configured tapered elements 126, 128 protruding from their respective outer surfaces 130, 132 to facilitate intermeshing and electrical connections. The tapered elements 126, 128 on the flexible and rigid members 122, 124 have tapered sides 136, 138, 140, 142 with geometries in accordance with U.S. Pat. Nos. 4,875,259 to Appeldorn and 5,071,363 to Reylek et al., and are arranged side by side forming a plurality of linear ridges 144, 146 and grooves 148, 150.

This flexible member 122 differs from that described above in FIGS. 2 and 2*a* in that the tapered elements 126 terminate at curved crowns 152 formed by coaxially coated wires 154. The coaxial coating is a conductive particle filled polymer layer 156. The surface 158 of this conductive particle filled polymer layer 156 is electrically conductive. The coaxially coated wires 154 extend the length of the flexible member 122 and connect to an external current or signal source (as shown in FIG. 1). The body 160 of the flexible member 122 is non-conducting and is made of an electrically insulating material, such as that for the flexible member of FIGS. 1, 2 and 2*a*.

The electrically conducting rigid member 124 differs from the rigid member 28 shown and described above in FIGS. 2 and 2*a* in that the outer surface 132 of the rigid member 124 includes grooves 150 with curved troughs 166, to correspond with and accommodate the coaxially coated wires 154, which form the curved crowns 152 of the flexible member 122, upon intermeshing. However, since it is preferred that there be cavities between the flexible and rigid members when intermeshed together, the radius of curvature of the curved troughs 166 need not exactly correspond to the radius of curvature of the curved crowns 152 of the flexible member 122.

Electrically conducting (metalized) segments 168 extend along a substantial portion of the grooves 150, with the remainder of the grooves 150 not metalized. Upon intermeshing, these electrically conducting segments 168 surround and contact the coaxially coated wires 154, for forming sufficient electrical contacts with the conductive particle filled polymer layer 156 on the coaxially coated wires 154. The intermeshing engagement results in cavities (not shown) between the flexible member 122 and the rigid member 124, due to the frictional forces associated with the sides of the intermeshing tapered elements 126, 128. The degree of the frictional forces, and ultimately the adherence, varies depending upon the angle of the taper and/or the frictional forces associated with the sides of the intermeshing tapered elements 126, 128. The curved crowns 152 can touch the curved troughs 166 as long as the force associated therewith is greater than the frictional forces associated with the respective tapered sides 136, 138, 140, 142. As a result, the flexible and rigid members 122, 124 are retained together by sufficient frictional forces created by the interlocking tapered elements 126, 128, so as not to be easily separated, but can be manually separated from this intermeshing engagement if so desired. The electrically conducting segments 168 can be connected to terminals (similar to that shown in FIG. 2) which are placed into contact with the electrically conducting segments 168 through openings 169 for receiving wires for subsequent connection to an external device.

Both the electrically conducting flexible member 122 and the rigid member 124 are made of the materials as described for the locking taper connector of FIGS. 2 and 2*a* above. This locking taper connector 120, can be used along a baseboard as shown in FIG. 1, or in conjunction with printed circuit boards, as shown in FIG. 3.

Figure 5:
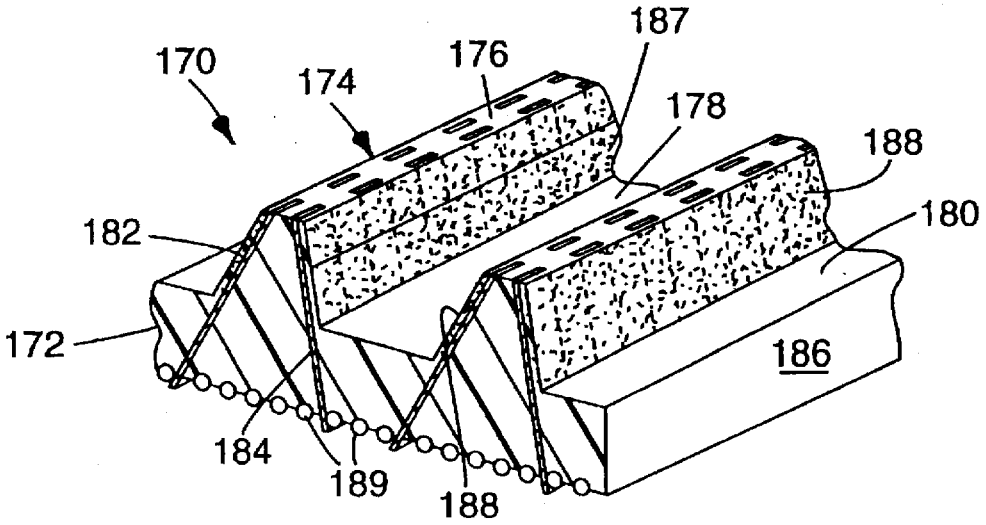
FIG. 5 is a broken away perspective view of a fourth embodiment of the present invention.

FIG. 5 shows a portion of a fourth locking taper connector 170 of the invention. The connector 170 includes a flexible electrically conducting member 172, having protruding tapered elements 174, with structures and geometries similar to those detailed in FIGS. 2 and 2*a* above. These tapered elements 174 are arranged side by side to form linear ridges 176 and grooves 178. Each groove 178 is provided with a trough 180, which separates adjacent tapered elements 174. This flexible member 172 may be intermeshed with a rigid member similar to the rigid member 28 described above in FIGS. 2 and 2*a*, having corresponding tapered elements on an outer surface to form an electrical connection.

In the flexible member 172, multiple flat wire ribbons 182, 184 are imbedded in the body 186 of the flexible member 172 and each wire ribbon 182, 184 extends from the tapered elements 174 through the body 186 to a point outside the body 186. These wire ribbons 182, 184 contact electrically conductive particles 187 impregnated into the tapered elements 174. These particles 187 form electrically conductive peripheral surfaces 188. This arrangement makes these tapered elements 174 pressure sensitive.

Each flat wire ribbon 182, 184 is connected to a current carrying wire 189, which is part of a group of wires running the length of the flexible member 172. These wire groups may be mounted within, partially within, or alongside and external to the body 186, if used along a baseboard or the like. If these wire groups are mounted on a printed circuit board, the flat wire ribbons 182, 184 extending outside of the body 186 may be soldered or pressure engaged into a printed circuit board.

Figure 6:
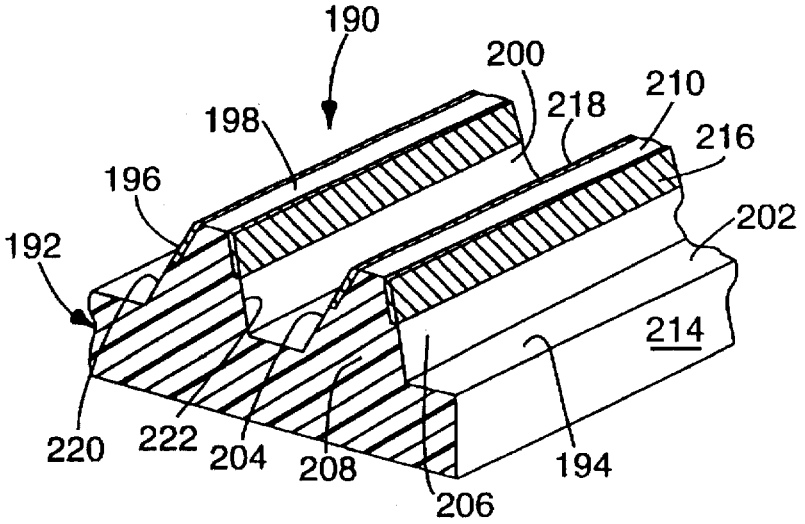
FIG. 6 is a broken away perspective view of a fifth embodiment of the present invention.

FIG. 6 shows a portion of a fifth locking taper connector 190 of the present invention. The connector 190 includes a flexible electrically conducting member 192, having an outer surface 194 with protruding tapered elements 196, having structures and geometries similar to those detailed in FIGS. 2 and 2*a* above. These tapered elements 196 are arranged side by side to form linear ridges 198 and grooves 200. Each groove 200 is provided with a trough 202 which separates adjacent tapered elements 196. The tapered elements 196 include sides 204, 206 and terminate in crowns 208 having flat surfaces 210. This flexible member 192 is designed to be intermeshed with a rigid member similar to the rigid member 24 described above in FIGS. 2 and 2*a*, having tapered elements 196 on an outer surface 194 to form electrical connections.

The flexible member 192 includes a body 214 of an electrically insulative material, as described for FIGS. 2 and 2*a* above. Flat current carrying and conducting wire ribbons 216, 218 are embedded in the crowns 208 of the tapered elements 196 at opposite sides. Each flat wire ribbon 216, 218 receives electric current or signals from a power source (not shown) and extends along the tapered elements 196, along the length of the flexible member 192. Unlike the flexible electrically conducting members of FIGS. 1–4, which may be pressure sensitive, or FIG. 5, which is pressure sensitive, this flexible member 192 is not pressure sensitive due to the flat wire ribbons 216, 218 on the outer surface of the tapered elements 196.

This flexible member 192 is preferably made by injection molding the polymer (elastomer) forming the body 214 of the flexible member 192. According to this technique, flat wire ribbons are placed along the walls of the mold such that the resultant flexible member 192 has oppositely disposed flat wire ribbons 216, 218, embedded within the body 214, such that they remain flush with the surfaces 220, 222 formed by the sides of the tapered elements 204, 206 and the flat crown surfaces 210. Alternately, the flexible member 192, could be made by extruding the body 214 and laminating the flat wire ribbons 216, 218 thereon.

Similar to the connector of FIGS. 2 and 2*a*, this flexible electrically conducting member 192, in combination with a correspondingly configured electrically conducting rigid member, is suitable for use along baseboards, in printed circuit boards, and the like. However, when used on baseboards, the flexible member 192 should be covered to avoid accidental short circuiting.

Figure 8:
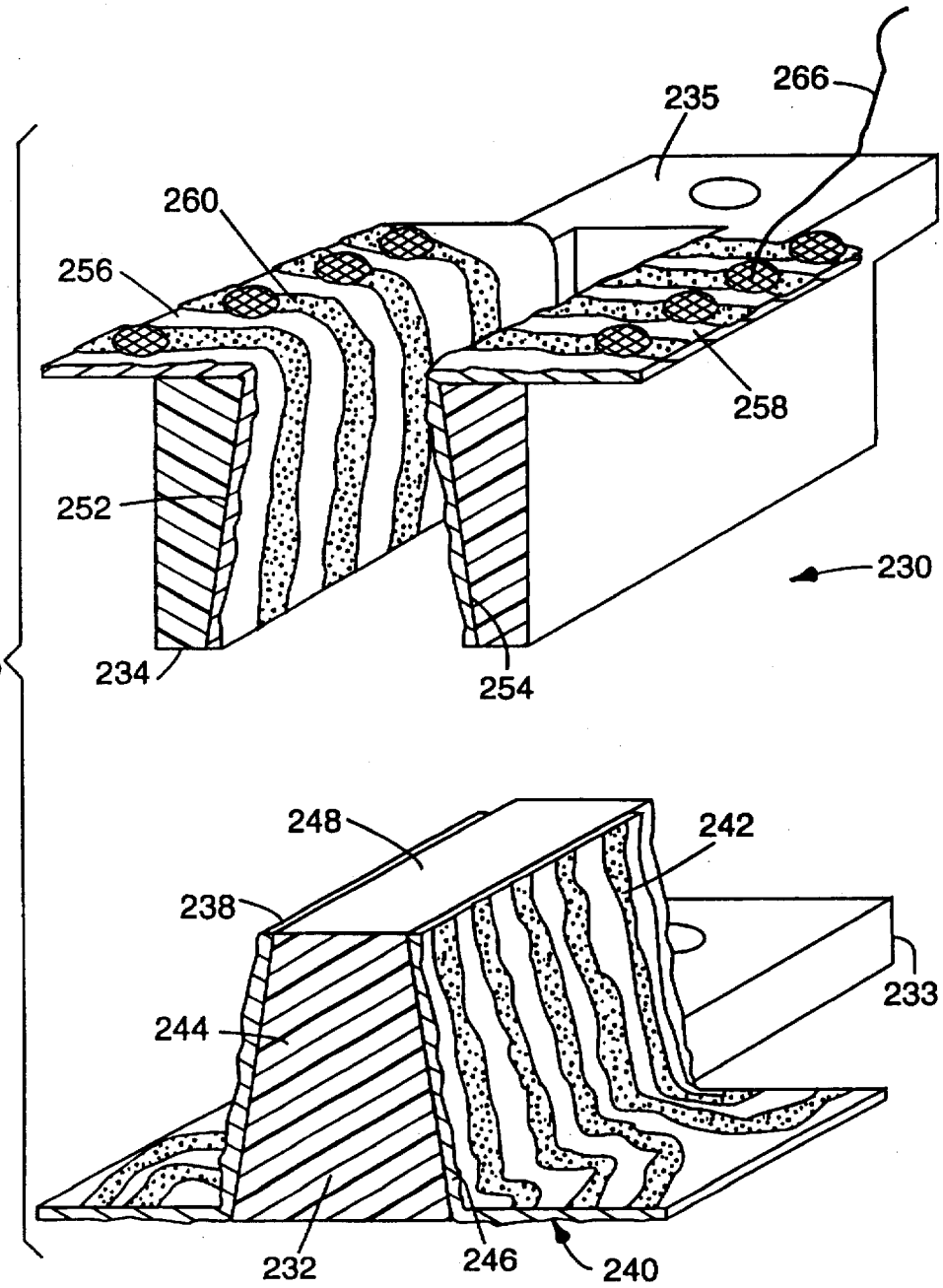
FIG. 8 is a broken away exploded view of a sixth embodiment of the present invention.

FIG. 8 shows a sixth locking taper connector 230 of the present invention. The connector components comprise a flexible member 232 with a mounting tab 233 and a correspondingly configured rigid member 234 with a mounting tab 235. When these flexible and rigid members 232, 234 are brought into contact with each other and intermeshed, electrical connections are made.

The flexible member 232 has at least one tapered element 238, having taper shapes and geometries in accordance with the tapered elements of the flexible member described in FIGS. 2 and 2*a* above. A flexible circuit 240 with conductive circuit traces 242, is layered over the sides 244, 246 of the tapered element 238, and extends along the plane formed by the bottom of the tapered element 238. The top 248 of the tapered element 238 is preferably free of circuit material, but needs only to be free of circuit traces 242, to avoid short circuiting. If the flexible member 232 includes plural tapered elements, these extended portions of the flexible circuit would be in the grooves between the tapered elements.

The rigid member 234 includes elements with tapered sides 252, 254, having taper shapes and geometries in accordance with those tapered elements on the rigid member described above in FIGS. 2 and 2*a* above. Flexible circuits 256, 258 with conductive circuit traces 260 are layered over the tapered sides 252, 254 and extend along the plane formed by the top of the rigid member 234. Wires 266 or other suitable electrical contact members may be soldered or pressure engaged to these conductive circuit traces 260. If this rigid member 234 included plural elements, the flexible circuits 256, 258 would terminate at the ends of the rigid member 234.

The rigid member 234 may be intermeshed with the flexible member 232 at multiple predetermined locations, to make a proper electrical connection. Specifically, upon intermeshing, these conductive circuit traces 242, 260 on the respective flexible and rigid members 232, 234, contact each other, in an engagement known as a "contact over contact." This contact over contact engagement gives rise to sufficient electrical connections.

The flexible member 232 and the rigid member 234 are made from the materials described above, by the techniques described above. The flexible circuits 240, 256, 258, are preferably made of polyimide film with copper circuit traces. These copper circuit traces preferably include a layer of laminated or electroplated copper, covered by a thin layer of chemically deposited nickel, which is covered with gold plating (by electroplating). The gold plating provides enhanced electrical contact and serves as a protective coating for the copper, as the gold inhibits oxidation of the copper. These flexible circuits 240, 256, 258 are placed on the respective flexible and rigid members 236, 250 by adhesive bonding or other conventional fastening techniques.

Figure 9:
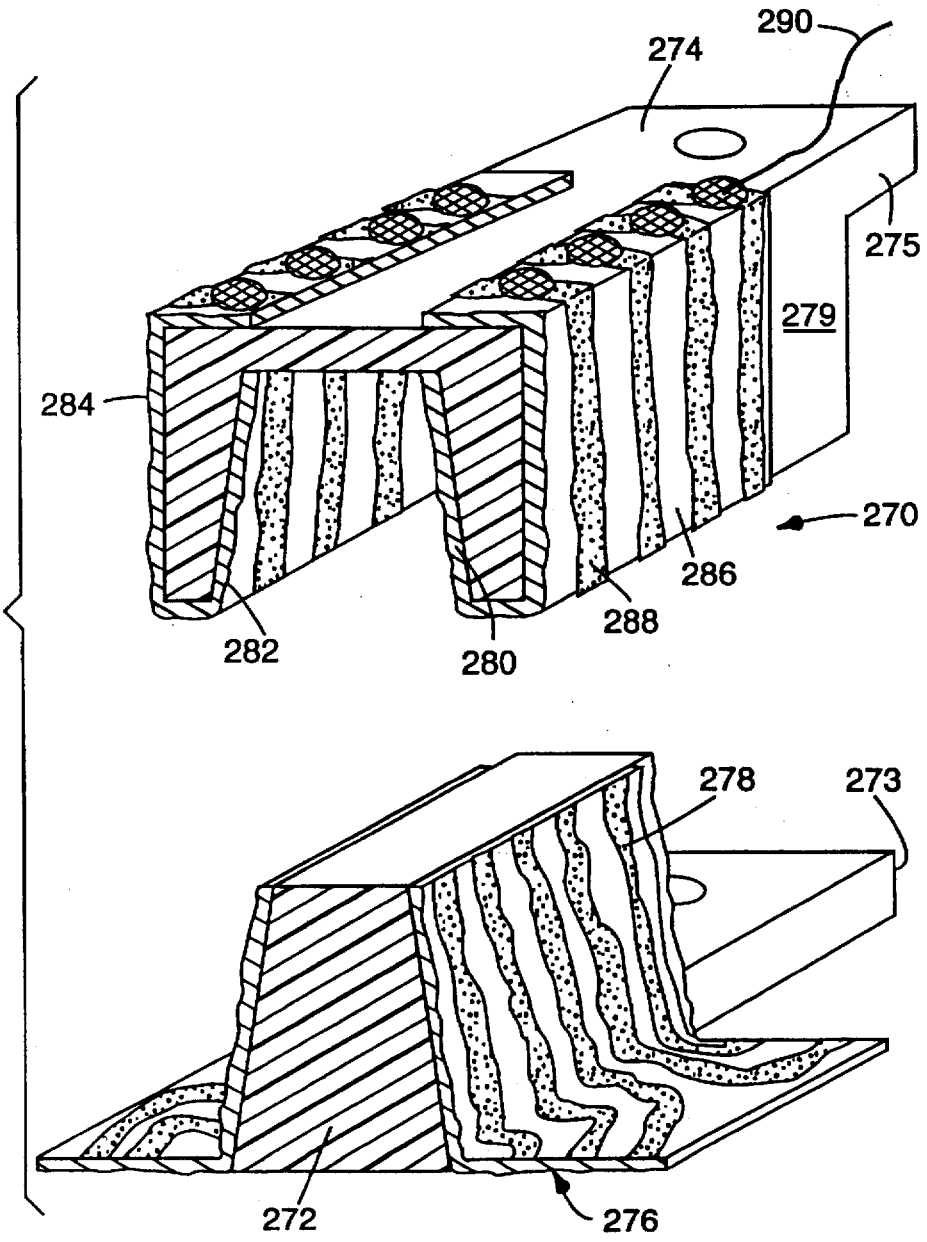
FIG. 9 is a broken away exploded view of a seventh embodiment of the present invention.

FIG. 9 shows a seventh locking taper connector 270 of the present invention. The connector components are in the form of a flexible member 272 with a mounting tab 273, and a correspondingly configured rigid member 274 with a mounting tab 275. The flexible member 272 includes a flexible circuit 276, with conductive circuit traces 278, and is identical to that of the flexible member 232 of FIG. 8.

The rigid member 274 is preferably "U" shaped, with open ends, and surrounds and covers the flexible member 272. The rigid member 274 includes a body 279 with tapered sides 280, 282, these tapered sides 280, 282 having shapes and geometries in accordance with those tapered elements described above in FIGS. 1, 2, and 2*a*. Flexible circuits 284, 286, with conductive circuit traces 288, are wrapped around the body 279, terminating at the top of the rigid member 274. Wires 290 or other suitable electrical contact members may be soldered or pressure engaged to these conductive circuit traces 288. Similar to the locking taper connector of FIG. 8, the flexible member 272 may be intermeshed with the rigid member 274 at a predetermined location, such that the respective conductive circuit traces 278, 288 form a contact over contact engagement to make the requisite electrical connections.

The rigid member 274 is made in a manner similar to that of the rigid member 234 of FIG. 8. The flexible circuits 284, 286 are attached to the rigid member 274 by adhesive bonding or other conventional fastening techniques.

EXAMPLE 1

Flat films with different concentrations of conductive particles were prepared in order to analyze pressure sensitivity as a function of particle loading. A first film was prepared by mixing 3.2 grams of Silastic Type-J RTV Silicone Rubber (Dow Corning Corp., Midland, Mich.) with 5.3 grams of Novamet INCO Nickel, type 123 (Novamet Corp., Wyckoff, N.J.). The mixture was spread onto a polyethylene sheet and cured for 24 hours at room temperature. The resultant product was skived with a razor blade into sheets, to produce 0.025 centimeter thick samples.

A second film was prepared by mixing 3.2 grams of Silastic Type-J RTV Silicone Rubber with 6.4 grams of Novamet INCO Nickel, type 123. The preparation, curing and cutting steps are identical to those above, and 0.022 centimeter thick samples were prepared.

A metal probe with an area of 0.0172 square centimeters was used to electrically contact the sample on the on the top face and a large metal plate was attached to the back face, in order to simulate the behavior of a flexible member, like that shown in FIGS. 1–6. Pressure was applied with a small press and the electrical resistance was measured at each test condition. The results of these measurements are plotted in FIG. 7, which is a graph of resistance versus applied pressure. The first film yielded curve 300, while the second film yielded curve 302. From these two curves 300, 302, it can be concluded that the sample with the greater concentration of particle loading exhibits greater pressure sensitivity, than a sample with a lesser concentration of particle loading, as resistance decreased faster with increasing pressure in the second film than the first film.

EXAMPLE 2

A flexible member in accordance with the invention, shown in FIGS. 1–3, was prepared by mixing 15.0 grams of Silastic Type-J RTV Silicone Rubber (Dow Corning Corp., Midland, Mich.), 30.0 grams of Novamet 73.5% Nickel coated Carbon and/or Synthetic Graphite (lot #88-486B) (Novamet, Corp., Wyckoff, N.J.) and 5.0 grams of Novamet Nickel Flake Powder, type HCA-1 (Novamet, Corp. Wyckoff, N.J.). The mixture was spread into a grooved TEFLON mold shaped to afford a member like that of the flexible member of FIG. 2. Specifically, the mold configuration included, groove depths of 0.191 centimeters and groove pitches of 0.127 centimeters and an included angle of 6 degrees.

Excess material was removed from the surface of the mold, so that only the grooved areas contained material. Stranded copper wires, with seven individual strands 0.018 centimeters in diameter and with an overall diameter of 0.051 centimeters after stranding, were inserted into the grooves using a small spatula.

An insulated support substrate was prepared by mixing 5.0 grams of Silastic Type-J RTV Silicone Rubber without any particles and spreading this mixture over the top of the grooves. This mixture was cured for 24 hours at room temperature and a light pressure was applied during curing.

While embodiments of the present invention have been described so as to enable one skilled in the art to practice the techniques of the present invention, the preceding description is intended to be exemplary and should not be used to limit the scope of the invention, which should be determined by reference to the following claims.

What is claimed is:

1. An intermeshable electrical connector comprising:

a flexible electrically conductive member having an outer surface, a plurality of electrically conductive protruding elements, the elements forming the outer surface; and a rigid member including at least one surface having electrically conductive elements correspondingly configured to those of the flexible member;

whereby the rigid member is randomly placable along the flexible member and when brought into engagement with the flexible member, the electrically conductive elements of the flexible member and the rigid member are retained in a releasable attachment with a force sufficient to ensure electrical connection and subsequent release and reconnection.

2. The electrical connector of claim 1, wherein the electrically conductive protruding elements of the flexible member include a plurality of solid tapered elements, each tapered element having at least one side inclined relative to a common plane at an angle sufficient to form a taper.

3. The electrical connector of claim 2, wherein the tapered elements include at least one electrically conductive peripheral surface.

4. The electrical connector of claim 2, wherein the electrically conducting elements on the rigid member include a plurality of solid tapered elements, each tapered element having at least one side inclined relative to a common plane at an angle sufficient to form a taper, and each tapered element having electrically conducting segments along a portion thereof.

5. The electrical connector of claim 4, wherein the tapered elements of the flexible member and the rigid member have two sides, and the plurality of tapered elements are arranged side by side to form a plurality of linear ridges and grooves, whereby the sides of adjacent elements form the sides of each groove, and the sides of each tapered element meet at each ridge.

6. The electrical connector of claim 5, wherein each of the flexible and the rigid members comprises a trough within the groove between the adjacent tapered elements.

7. The electrical connector of claim 5, wherein each of the first and second members further comprises a crown along each ridge, each crown between the sides of the tapered elements.

8. The electrical connector of claim 3, wherein the electrically conductive protruding elements include at least one wire imbedded in each of the tapered elements, the wires in communication with electrically conducting particles extending from the wires to the electrically conductive peripheral surface of the tapered elements.

9. An electric current or signal carrying member comprising:

a body having a plurality of electrically conductive tapered elements forming the outer surface of the electric current or signal carrying member, the body further comprising electrically conducting particles; and wires imbedded in the body in communication with the electrically conducting particles, such that electric current or signals can be transmitted to external devices when a correspondingly configured electrically conducting member is intermeshed in a releasably attachable frictional engagement with the electric current or signal carrying member.

10. The electric current or signal carrying member of claim 9, wherein the tapered elements include at least one electrically conductive peripheral surface, the wires are in the tapered elements and are in communication with the electrically conducting particles, the electrically conducting particles extending from the wires to the electrically conductive peripheral surface.

11. The electric current or signal carrying member of claim 10, wherein the member extends a substantial length.

12. The electric current or signal carrying member of claim 11, wherein the wires and the electrically conducting particles in communication with the wires extend the entire length of the tapered elements for carrying electric current or signals over the substantial length without an appreciable voltage drop.

13. The electric current or signal carrying member of claim 9, wherein the body is made of a flexible material.

14. An electrical connector comprising:

a flexible electrically conducting member extending a substantial length, the flexible member including a plurality of electrically conductive tapered elements extending the length of the flexible member, the tapered elements forming the outer surface of the flexible member, the tapered elements including means for carrying electric current or signals the length of the flexible member without an appreciable drop in voltage over the length; and a rigid member including at least one surface having electrically conductive elements correspondingly configured to those of the flexible member;

whereby the rigid member is placable at a desired random location along the flexible member and when brought into engagement with the flexible member, the electrically conductive elements of the flexible member and the rigid member are retained in a releasable attachment with a force sufficient to ensure electrical connection and subsequent release and reconnection.

15. The electrical connector of claim 14, wherein the electric current or signal carrying means includes flat wire ribbons.

16. The electrical connector of claim 14, wherein each of the tapered elements has at least one electrically conductive peripheral surface and the electric current or signal carrying means includes at least one wire embedded in each of the tapered elements, the wires in communication with electrically conducting particles extending from the wires to the electrically conductive peripheral surface.

17. The electrical connector of claim 14, wherein the electrically conductive elements on the rigid member include a plurality of tapered elements, each tapered element having at least one side inclined relative to a common plane at an angle sufficient to form a taper, and each tapered element having electrically conducting segments along a portion thereof.

* * * * *